US008978760B2

(12) United States Patent
Trummer et al.

(10) Patent No.: US 8,978,760 B2
(45) Date of Patent: Mar. 17, 2015

(54) METHOD OF PLACING BALL SEALERS FOR FLUID DIVERSION

(71) Applicant: Schlumberger Technology Corporation, Sugar Land, TX (US)

(72) Inventors: Sascha Trummer, Sugar Land, TX (US); Eric Clum, Sugar Land, TX (US); Curtis L. Boney, Houston, TX (US); Jorge E. Lopez de Cardenas, Sugar Land, TX (US); Belgin Baser, Oldenburg (DE); Jason Swaren, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 14/010,767

(22) Filed: Aug. 27, 2013

(65) Prior Publication Data

US 2013/0341014 A1 Dec. 26, 2013

Related U.S. Application Data

(62) Division of application No. 12/273,328, filed on Nov. 18, 2008, now Pat. No. 8,561,696.

(51) Int. Cl.

| | |
|---|---|
| ***E21B 33/13*** | (2006.01) |
| ***E21B 33/02*** | (2006.01) |
| ***E21B 33/138*** | (2006.01) |
| ***E21B 47/09*** | (2012.01) |

(52) U.S. Cl.

CPC ..... *E21B 33/02* (2013.01); *E21B 33/138* (2013.01); *E21B 47/09* (2013.01)

USPC ..... 166/284; 166/252.6; 166/193

(58) Field of Classification Search

CPC ..... E21B 33/02; E21B 33/138; E21B 47/09

USPC ..... 166/284, 193, 252.6, 318, 325; 428/407; 156/170

See application file for complete search history.

(56) References Cited

U.S. PATENT DOCUMENTS 3,292,700 A * 12/1966 Berry ..... 166/284
2003/0192690 A1 * 10/2003 Carlson et al. ..... 166/250.04

* cited by examiner

*Primary Examiner* — Yong-Suk (Philip) Ro

(74) *Attorney, Agent, or Firm* — Rachel Greene; Jeremy D. Tillman; Tim Curington

(57) ABSTRACT

A method for placing ball sealers within a well formed within a subterranean formation for sealing holes in a casing of the well is carried out by performing at least one of two operations. The first operation involves providing a tag with at least one ball sealer or a carrier fluid containing the at least one ball sealer to facilitate monitoring of the location of the ball sealer. A tag monitoring device is provided within the well for monitoring the location of the tag. The ball sealer and carrier fluid with the tag are introduced downhole into the well. Information from the monitor device regarding the location of the tag is communicated to a remote monitoring location to the thereby provide an indication of the location of the tag within the well to a surface location. In the second operation a container is provided within the well at a known location downhole within the well. The container contains at least one ball sealer. The ball sealer or sealers are released from the container within the well at the known location in response to an instruction initiated from a surface location.

11 Claims, 4 Drawing Sheets

METHOD OF PLACING BALL SEALERS FOR FLUID DIVERSION

BACKGROUND

The statements in this section merely provide background information related to the present disclosure and may not constitute prior art.

Wellbore isolation during stimulation (for example by fracturing, acidizing, and acid fracturing) is performed by a variety of methods within the oilfield industry. One of the traditional approaches involves the use of ball sealers, which are meant to seal the perforations in the casing and prevent fluid in the wellbore from flowing through the perforations into the formation.

Ball sealers are typically spheres designed to seal perforations that are capable of accepting fluid, and thus divert reservoir treatments to other portions of a target zone. Ball sealers are slightly larger than the perforations and are incorporated in the treatment fluid and pumped with it. They are carried to the perforations by the fluid flow, seat in the holes, and are held there by differential pressure. The effectiveness of this type of mechanical diversion requires keeping the balls in place and completely blocking the perforations, and depends on factors such as the differential pressure across the perforation, the geometry of the perforation, and physical characteristics of the ball sealers.

If the ball sealers have reached the entrance hole of the perforation tunnels and a pressure up event does not occur, this may indicate that there is significant flow past the ball sealers and into the formation. In such cases, it is important that pumping is stopped to ensure any proppant fracturing fluid or other treatment fluid is not washed away. Conversely, a premature pressure event may be realized if the proppant of the fracturing fluid screens out. In such cases, the ball sealers and proppant slurry may lie across a subsequent zone to be stimulated. This can result in an immediate ball out (balls landing), premature screenout (proppant slurry) or stuck perforation guns in the subsequent zone to be stimulated.

The accurate displacement of ball sealers is especially important when conducting "just in time perforating" (JITP) operations. In such operations, multiple zones or intervals are sequentially perforated, with fracturing fluids being introduced into the formation to stimulate the perforated zone while the perforating gun remains in the well. Ball sealers are introduced into the wellbore to seal the perforations so that a subsequent zone may be treated. When a pressure event is observed as a result of the ball sealers sealing perforations in a previously fractured zone, the next zone to be treated is perforated. The JITP operation allows multiple zones or intervals to be quickly and efficiently treated in a single, continuous pumping operation. Inaccurate displacement of the ball sealers impedes the operation and prevents subsequent zones from being treated until the ball sealers are accurately placed.

Ball sealer displacement is conventionally measured through the displaced volume of fluid that is introduced into the wellbore, as measured at the surface. This can lead to severe inaccuracies in displacement of the ball sealers. This can be due to a variety of different factors. These may include inaccuracies in the exact volume of fluid used in the treatment, inaccuracies in the exact volume of fluid between the first and last ball sealers being pumped, inaccuracies in the standard pump volume and inaccuracies due to ball sealer movement within the displacement fluid while traveling downhole.

Because of the inaccuracies in displacement of ball sealers using conventional methods improvements are needed.

SUMMARY

In some aspects, embodiments described herein relate to methods for placing ball sealers within a well formed within a subterranean formation for sealing holes in a casing of the well is carried out by performing at least one of two operations. The first operation involves providing a tag with at least one ball sealer or a carrier fluid containing the at least one ball sealer to facilitate monitoring of the location of the ball sealer. A tag monitoring device is provided within the well for monitoring the location of the tag. The ball sealer and carrier fluid with the tag are introduced downhole into the well. Information from the monitor device regarding the location of the tag is communicated to a remote monitoring location to the thereby provide an indication of the location of the tag within the well to a surface location. In the second operation a container is provided within the well at a known location downhole within the well. The container contains at least one ball sealer. The ball sealer or sealers are released from the container within the well at the known location in response to an instruction initiated from a surface location.

In another aspect, embodiments involve methods for placing ball sealers within a well formed within a subterranean formation for sealing holes in a casing of the well. Accordingly a tag with at least one ball sealer or a carrier fluid containing the at least one ball sealer is provided to facilitate monitoring of the location of the at least one ball sealer. Also, a tag monitoring device within the well for monitoring the location of the tag is provided, and the ball sealer(s) and carrier fluid are introduced downhole with the tag into the well. Information may be communicated from the monitor device regarding the location of the tag to a remote monitoring location to provide an indication of the location of the tag within the well to a surface location.

In yet another aspect, a method for placing ball sealers within a well formed within a subterranean formation for sealing holes in a casing of the well includes providing a container within the well at a known location downhole within the well, where the container containing at least one ball sealer. The ball sealer(s) is from the container within the well at the known location in response to an instruction initiated from a surface location.

BRIEF DESCRIPTION OF THE DRAWINGS

For a more complete understanding of the present invention, and the advantages thereof, reference is now made to the following descriptions taken in conjunction with the accompanying figures, in which.

DETAILED DESCRIPTION

The description and examples are presented solely for the purpose of illustrating the different embodiments should not be construed as a limitation to the scope and applicability. While any compositions or structures may be described herein as comprising certain materials, it should be understood that the composition could optionally comprise two or more different materials. In addition, the composition or structure can also comprise some components other than the ones already cited. Although some of the following discussion emphasizes fracturing, the compositions and methods may be used in any well treatment in which diversion is needed. Examples include fracturing, acidizing, water control, chemical treatments, and wellbore fluid isolation and containment. Embodiments will be described in terms of treatment of vertical wells, but is equally applicable to wells of any well orientation. Embodiments will be described for hydrocarbon production wells, but it is to be understood that they may be used for wells for production of other fluids, such as water or carbon dioxide, or, for example, for injection or storage wells. It should also be understood that throughout this specification, when a range is described as being useful, or suitable, or the like, it is intended that any and every value within the range, including the end points, is to be considered as having been stated. Furthermore, each numerical value should be read once as modified by the term "about" (unless already expressly so modified) and then read again as not to be so modified unless otherwise stated in context. For example, "a range of from 1 to 10" is to be read as indicating each and every possible number along the continuum between about 1 and about 10. In other words, when a certain range is expressed, even if only a few specific data points are explicitly identified or referred to within the range, or even when no data points are referred to within the range, it is to be understood that the inventors appreciate and understand that any and all data points within the range are to be considered to have been specified, and that the inventors have possession of the entire range and all points within the range.

When multiple hydrocarbon-bearing zones are stimulated by hydraulic fracturing or chemical stimulation, it is desirable to treat the multiple zones in multiple stages. In multiple-zone fracturing, for example, a first pay zone is fractured. Then, the fracturing fluid is diverted to the next stage to fracture the next pay zone. The process is repeated until all pay zones are fractured. Alternatively, several pay zones may be fractured at one time, if they are closely located and have similar properties. Diversion may be achieved with various means. Some commonly used methods for diversion in multiple fracturing stages are bridge plugs, packers, other mechanical devices, sand plugs, limited entry, chemical diverters, self-diverting fluids, and ball sealers.

Figure 1:
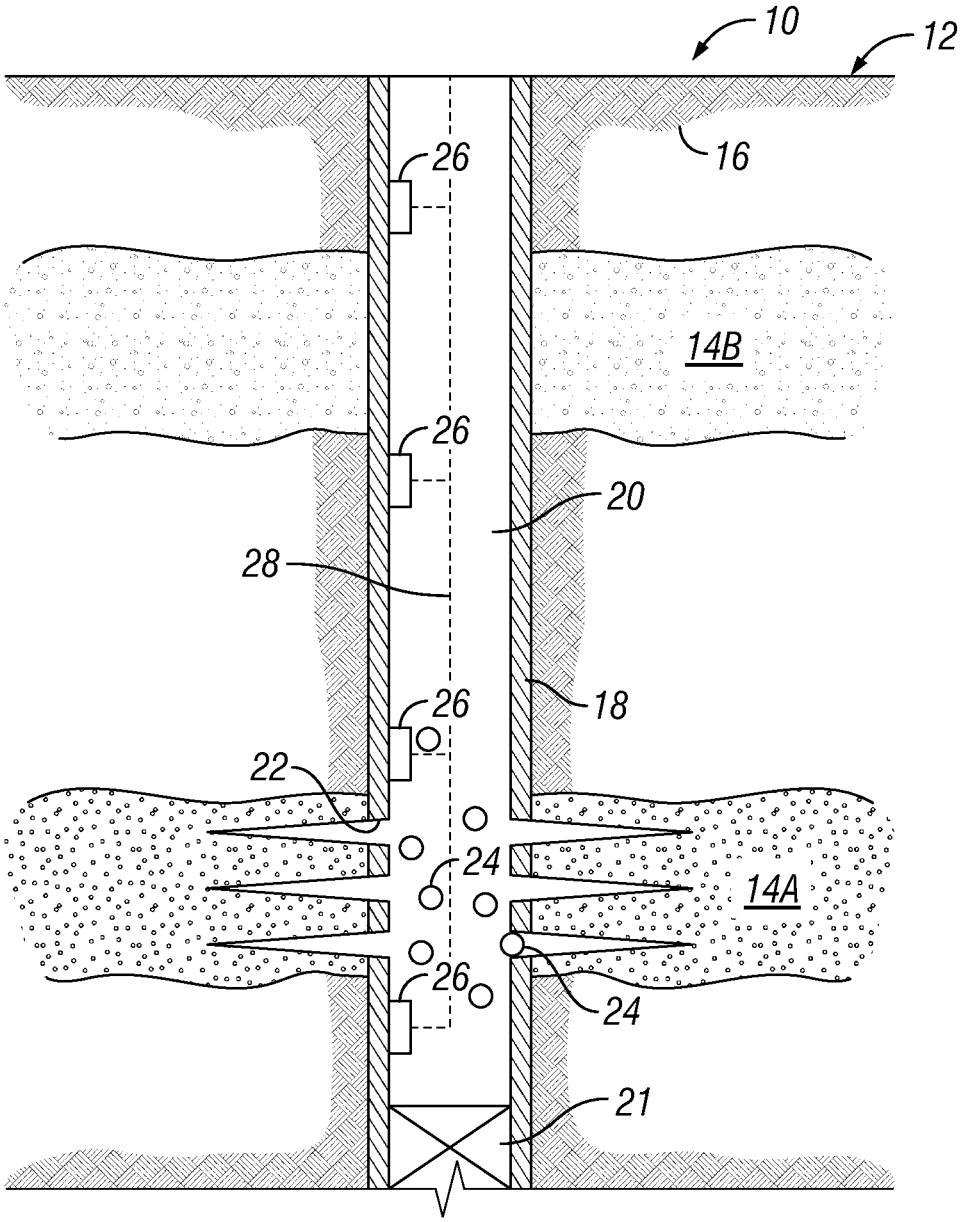
FIG. 1 is an elevational cross-sectional view of a downhole portion of a well formed in a subterranean formation employing tag monitoring devices provided on a casing of the well for providing information regarding the location of monitoring tags for monitoring the location of ball sealers used in diverting fluid flow to portions of the formation.

FIG. 1 illustrates a well 10 formed in a subterranean formation 12 having multiple hydrocarbon-bearing zones. The well 10 penetrates several zones of the formation 12. As shown, the zones indicated at 14A and 14B indicate hydrocarbon-producing or pay zones and the zones at 16 indicate non-producing zones. The zones 14A and 14B are spaced apart along the length of the well with the non-producing zones 16 interspaced between the producing zones 14A and 14B. A casing 18, which may extend from the wellhead (not shown) at the surface of the well 10, isolates the penetrated formation and the different zones from the wellbore 20. A packer or plug assembly 21 may be provided to isolate the wellbore 20 from the lower remaining portion of the casing 18.

As shown, the portion of the casing 18 isolating the lowermost producing zone 14A is perforated with several perforations or holes 22. The perforations 22 are typically formed with a perforating gun (now shown) that is lowered into the wellbore for this purpose. It should be noted that while the discussion herein has particular application to the placement of ball sealers for sealing perforations or holes formed by perforating guns, other openings or holes in the casing, and other methods of making them, fall within the scope of the invention, as well. For example, "perforations" may be holes cut in the casing by a jetting tool or by a chemical flash technique, for example using an explosive or a propellant.

The perforations or holes 22 in the casing 18 allow fracturing fluids or other treatment fluids to be introduced into the zone 14A through the wellbore 20. At completion of the fracturing operation or other fluid treatment, ball sealers 24 are introduced into the wellbore 22 to seal off the perforations 22 formed for zone 14A so that a second adjacent zone 14B may be treated.

The ball sealers 24 may be any known ball sealers, of any suitable composition and three dimensional shape. Nonlimiting examples include sphere, egg shaped, pear shaped, capsular, ellipsoid, granular, and the like, and the surfaces of such may vary from essentially smooth to rough. Ball sealers, and components forming them, may have any size and shape suitable for the application; sizes and shapes are selected on the basis of the size and shape of the holes to be sealed. In some instances, the longest diameter of ball sealers range from about ⅜" (0.95 cm) to about 1⅝" (4.13 cm), or from about ⅝" (0.59 cm) to about ⅞" (2.22 cm). Any suitable materials may be used to form the ball sealers. Nonlimiting examples of materials useful for making ball sealers include phenolic resin, nylon resin, syntactic foam, curable materials with high compressive strength, polyvinyl alcohol, collagen, rubber, polyisoprene, polyglycolic acid, and polylactic acid. Ball sealers may have a core of one material, typically rigid, and an outer layer of another, typically deformable, for example rubber over metal. Some of these materials have the ability to undergo elastic and/or plastic deformation under pressure, but this may not be sufficient to create satisfactory seals. Some of these materials may be degradable or soluble.

Provided with one or more of the ball sealers 24 is a monitoring tag. The tag may be any device that allows the location of the ball sealers 24 to be monitored from a remote location when detected by a monitoring device configured for cooperating with the monitoring tag. The tag may take a variety of different forms. These may include an RFID or transponder tag, a metal tag, a magnetic tag, a chemical tag (such as boron by nonlimiting example), an optically readable tag (e.g. bar code, color, shape, etc.), an ionizing radiation emitting tag (i.e. alpha-, beta- and gamma-radiation, e.g. PIP tag), a non-ionizing radiation emitting tag (e.g. visible light, UV, IR, microwave, radio, etc.), a sound emitting tag, or other wave emitting tag. The tag may be provided on the surface of the ball sealer, be imbedded within or otherwise incorporated with the tag. The tag may be the ball sealer itself, such as used with a motion detecting sensor that can sense solid objects of certain sizes or shapes within a fluid. The tags may be active or passive and provide a unique feature that allows the tags to be monitored by cooperating monitoring device. The tag may provide or emit a signal or indication of its presence independent from any other device. In such cases, the tag may be provided with a power source on the tag or ball sealer itself, if one is required, such as for emitting light or other electromagnetic waves. Other tags, such as chemical tags or ionizing radiation emitting tags, would not require a power source. Some tags may require the receipt of an inquiry from an external source. Examples of this would include a bar code tag, an RFID or transponder tag that remains passive and is either read or monitored by another device or transmits a response upon receiving a signal or other inquiry from another device. In some embodiments, the ball may implode or explode to make a sound the can be picked up by microseismic monitors.

Although in certain embodiments the tag is provided with the ball sealers themselves, they may also be incorporated in the fluid containing the ball sealers so that the tag is separate from the ball sealers. This may include different objects, materials or chemicals that are incorporated into the carrier fluid containing the ball sealers. Such tags may be intermixed into the particular portion of fluid containing the ball sealers or may be contained in portions of the carrier fluid upstream or downstream from the ball sealers. In some instances, where the tags are in the carrier fluid upstream or downstream from the ball sealers, they may be from about 0.25 bbls to about 2 bbls upstream or downstream.

A tag monitoring device 26 is provided in the wellbore 20 at a known depth or location within the well. The tag monitoring device 26 is configured for cooperating with the monitoring tags used for monitoring the location of the ball sealers. Thus, the monitoring device may include a RFID or transponder reader, a metal detector, magnetic detector, chemical detector, optical reader, an ionizing radiation detector (e.g. Geiger Counter), a non-ionizing radiation detectors (such as for visible light, UV, IR, microwave and radio waves), audio detectors, motion detectors, and the like.

The monitoring device 26 may include or be coupled to a signal generator (not shown) for generating a signal that is transmitted from the monitoring device to a remote monitoring location, which may be located at a surface location. The signal generator may be a hydraulic signal, electrical signal, electro-magnetic signal, sonic or pressure signal. These may be carried on a line or communication link 28, such as a hydraulic line or electrical wire, or may be transmitted through the fluid in the wellbore, such as through pressure pulses transmitted through the fluid.

The monitoring device 26 may be coupled to or installed as part of the casing string 18. In some instances, the monitoring device may be installed when the casing is initially assembled, run in the well and subsequently cement. The monitor may be an accessory to casing (such as about a 2 foot [0.6 meter] PUP joint with a sensor integrated therein. As shown in FIG. 1, multiple monitoring devices 26 are provided. These may be located immediately above and/or below the areas where the holes or perforations 22 are or are to be formed. As part of the casing 18, the location of the monitoring devices is provided at a known location. In some instances the monitoring devices would be near to the perforations. It may also be beneficial to know the position of ball sealers at multiple points within the wellbore. In such cases where the monitoring device 26 is coupled to the casing 18, the detection signal may be transmitted through a hydraulic control line 28 that may be provided on the outside of the casing. Alternatively, these signals could be transmitted wirelessly to surface, such as in the form of waves (i.e. sound), pulses (pressure, sound, etc.), high frequency, low frequency, and the like.

If multiple monitoring devices are utilized downhole at different locations within the same well, each monitoring device may configured for monitoring the same or different tags. Thus, a first monitoring device may be configured for reading a unique code from a first tag provided with a first set of ball sealers and a second monitoring device may be configured for reading a unique code from a second tag for a second set of ball sealers and so forth. Thus, when a first tag is in proximity to a second monitoring device the second monitoring device may not read the tag because it is not configured for reading the first tag. Thus no signal from the second monitoring device indicating the location of the tag and ball sealers may be produced. In other applications, all the monitoring devices may be configured for reading the tags used for multiple sets of ball sealers. Each monitoring device, which is at a known location, may have a unique identifier or signal so that the when a signal from the monitoring device is received, the location of the tag/ball sealer is known based upon the particular monitoring device providing the signal. The tags would operate in normal pressures observed in wellbores, such as up to about 20,000 PSI (1400 kg/cm$^2$) and up to about 500 Deg F. (260 Deg C.).

When fluid diversion from a zone is desired, the monitoring tags and tag monitoring device may be employed to ensure accurate placement of the ball sealers. Referring to FIG. 1, an initial perforated zone 14A where fluid diversion is desired is shown. Upon completion of the fracturing or other treatment operation for zone 14A, ball sealers 24 are introduced with a carrier fluid. Typically from about 20 to 30 ball sealers up to about 100 ball sealers or more may be used for fluid diversion for each zone. The carrier fluid may be the final portion of the treatment fluid or a separate carrier fluid. A monitoring tag or tags is/are provided with either the ball sealers or with the carrier fluid, as previously described. As the tags associated with the ball sealers 24 or carrier fluid approach the monitoring device 26 the monitoring device 26 detects the tag or tags and a signal is generated which is transmitted to the surface, such as through the line 28.

Using an operation at surface that wherein pump control, or control of any other suitable equipment, occurs in response to receiving a signal regarding the location of the ball sealers, either through manual or automated controls, helps to insure that the interval where the fluid is flowing and not effectively blocked, thus receiving optimum treatment. It may also help to insure that the perforation is blocked after the treatment.

Figure 2:
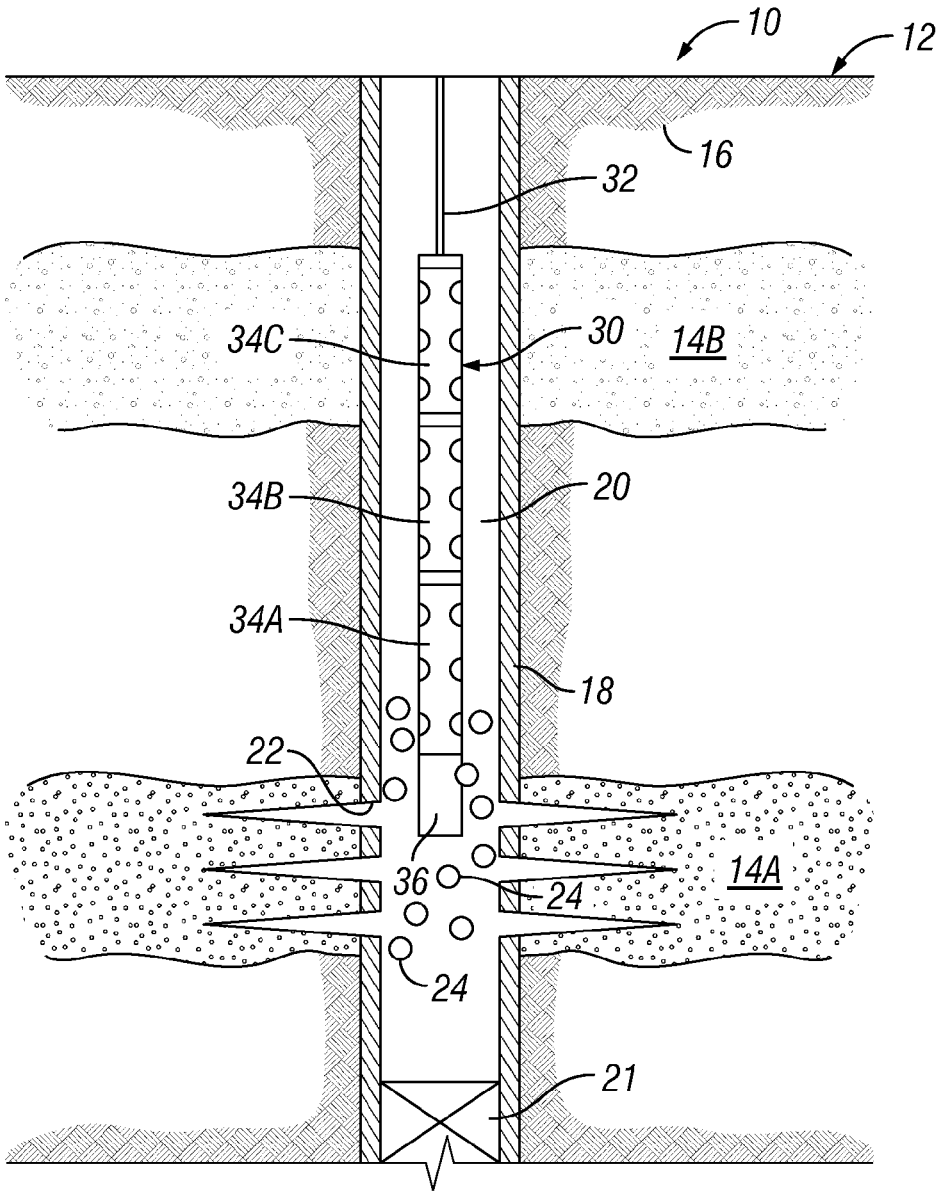
FIG. 2 is an elevational cross-sectional view of a downhole portion of a well formed in a subterranean formation employing a tag monitoring device carried on a carrying assembly that is lowered into the well for providing information regarding the location of monitoring tags for monitoring the location of ball sealers used in diverting fluid flow to portions of the formation.

FIG. 2 shows a variation to the embodiment of FIG. 1 employing the use of a monitoring tags and a monitoring device. Referring to FIG. 2, a well 10 is shown with a perforating gun assembly 30 disposed within the wellbore 20. Similar components of the well 10 to those shown in FIG. 1 are referenced with the same reference numerals. The perforating gun assembly 30 is coupled to a wireline cable 32 that extends into the wellbore 20 from the surface and is used to carry the assembly as well as to provide a communication link to the assembly 30 from the surface. The perforating gun assembly 30 is provided with several perforating gun sections (which may be perforating strips or perforating guns) 34 for performing multiple perforating operations for perforating the well casing 18.

Provided with the perforating gun assembly 30 is a tag monitoring device 36. The monitoring device 36 may be any of the tag monitoring devices described previously that is configured for cooperating with the monitoring tags for the ball sealers used in a given operation. The monitoring device 36 is shown at the lowermost end of the assembly 30 but may be located at different positions along the length of the assembly 30. Additionally, multiple monitoring devices 36 may be provided on the assembly 30. These may be screwed onto or otherwise coupled to the perforating gun assembly 30 and have a similar diameter or dimensions. Thus, for example, a monitoring device 36 may be provided adjacent to each perforating gun section(ec) for perforating a different zone or interval. Each of the different monitoring devices may also be configured for monitoring a unique monitoring tag associated with a different interval or zone that is to be sealed with the ball sealers.

The perforating gun assembly 30 may be used in JTIP perforating operations as well as other perforating operations. By way of one example, in a JTIP perforating operation, the perforating gun assembly 30 is lowered into the wellbore 20 by means of the wireline 32. A first perforating gun section 34A of the perforating gun assembly 30 is positioned within the wellbore 20 adjacent a first zone or interval 14A to be perforated and perforations 22 are formed in the casing 18. After perforation, treatment fluids, such as fracturing fluids, are introduced into the interval 14A through the perforations 22, to stimulate the formation.

Upon completion of the treatment of the first zone 14A, ball sealers 24, which may be included in the final portion of the treatment fluid, are introduced into the wellbore 20. The ball sealers 24 or the portion of the fluid containing the ball sealers are provided with a monitoring tag or tags, as has been described. As the tag or tags approach the monitoring device 36 the tags are detected and a signal is generated to the surface indicating that the ball sealers 24 are at or near the zone where fluid diversion is desired, and which is usually followed by an increase in pump pressure as a result of the sealing of the holes or perforations 22.

When the ball sealers 24 are in place and the perforations 22 are sealed in the area of the casing 18 around zone 14A, the perforating gun assembly 30 is immediately repositioned so that a perforating gun section 34B is located adjacent a next zone 14B to be treated. The casing 18 adjacent to the zone 14B is then perforated by means of perforating gun section 34B and the zone 14B is treated in a manner similar to that of zone 14A, previously described. Upon treatment, another set of ball sealers 24 are introduced into the wellbore 20 with monitoring tags. If necessary, the assembly 30 can be repositioned (raised or lowered) to provide the monitoring device 36 at a location near the perforations in the casing 18 near zone 14B if it is not so located.

In the JTIP operation, treatment fluids are continuously being pumped or introduced into the wellbore during treatment of multiple zones. After perforation and treatment of each zone, the perforating gun assembly 30 is positioned at the next zone to be treated, where the zone is perforated and the treatment process is repeated. The monitoring device 36, which is carried by the assembly 30, is relocated each time to the next zone to facilitate accurate placement of the ball sealers. Alternatively, the monitoring devices may be provided on the casing 18, as in the embodiment of FIG. 1, or the monitoring device may be carried on its own wireline (not shown), which is separate from that used to carry the perforating gun assembly 30.

Figure 3:
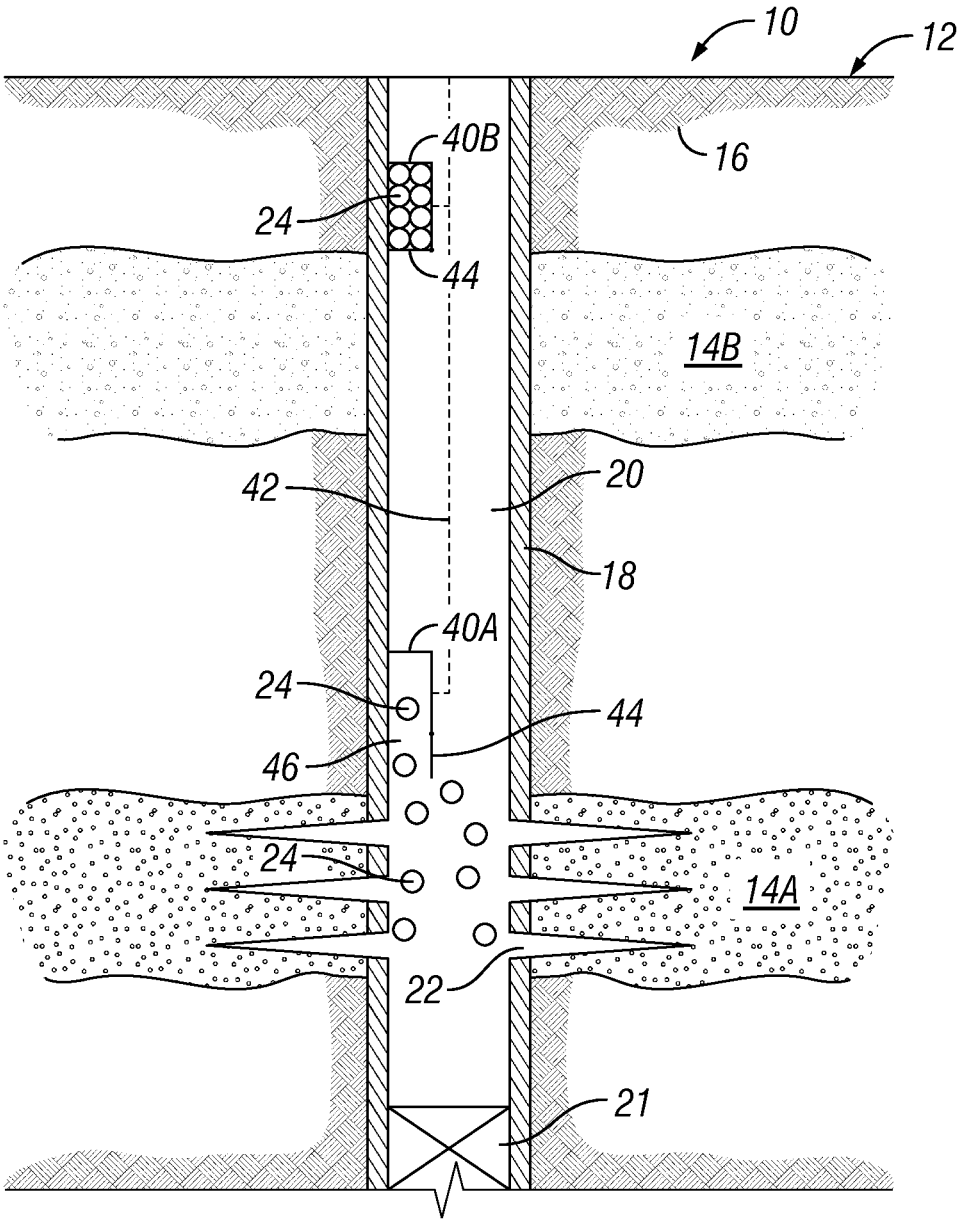
FIG. 3 is an elevational cross-sectional view of a downhole portion of a well formed in a subterranean formation employing downhole containers provided on the casing string of the well for releasing ball sealers into the wellbore for diverting fluid flow to portions of the formation.

In another embodiment, containers containing ball sealers are provided downhole to facilitate the accurate placement of the ball sealers. FIG. 3 shows a well 10 employing such containers 40. The well 10 is similar to that of FIGS. 1 and 2, with similar components labeled with the same reference numerals. Containers 40 are provided that are coupled to the well casing 18 and are installed during installation of the casing string. The containers 40 are spaced apart and may be located adjacent to zones to be stimulated, such as the zones 14A, 14B. A line or communication link 42, such as a hydraulic control line, may be provided that is coupled to the containers 40 and extends to the surface for controlling the containers 40.

The containers 40 may have a capacity to hold a sufficient number of ball sealers for sealing the perforated zones (e.g. 20 to 30 or more ball sealers). The containers 40 are each provided with one or more doors or closures 44 for selectively closing an opening or openings 46 of the container 40. Each container 40 is filled with ball sealers 24. In response to an instruction that may be transmitted through the line or link 42, the closure 44 is opened from a closed position to an open position to release the ball sealers 24 from the container 40 into the wellbore 20. It should be noted that communicating with the containers 40 may be through the fluid itself, such as through a pressure pulse. Alternatively, communication could be enabled through chemical dissolution or frequency activation. In the embodiment shown, the containers 40 are located generally at a position above the zones where the perforations are to be formed. This may be from a as few as about 2 feet (0.6 m) to about 500 feet (150 m) from the area to be perforated. However, in some instances, due to the uncertainty of exact zones height to be perforated from about 10 feet (3 m) to about 100 feet (30 m) may be the case, dependent of the amount of zones in a certain area (since multiple stacked zones may require different spacing). In certain applications, however, the containers 40 may be located at a position below the holes or perforations the ball sealers are to seal, such as described with respect to the embodiment of FIG. 4, as is described later on.

With reference to FIG. 3, in use, after perforation and at the conclusion of the treatment (e.g. fracturing) of a first zone, such as zone 14A, the container 40A is actuated by a command through link 42 so that the closure 44 is opened to release the ball sealers 24 within the container 40. A carrier fluid, which may be a final portion of the treatment fluid, carries the released ball sealers to the perforations 22 so that the perforations 22 are sealed. This effectively minimizes the volume of displacement or carrier fluid that must be used to seal perforations 22.

After the perforations 22 of the first zone 14A are sealed, a second zone, such as zone 14B, may be treated in a similar manner. Perforations (not shown) are formed in the casing 18 adjacent the zone 14B and the stimulation or other treatment is carried out. At the conclusion of the treatment of the zone 14B, the container 40B may be actuated to release the ball sealers 22 carried therein to seal the perforations for zone 14B.

In some applications, tags and monitoring devices, such as those previously described with respect to FIGS. 1 and 2, may be employed with the downhole containers containing the ball sealers to further ensure and identify accurate placement of the ball sealers.

Figure 4:
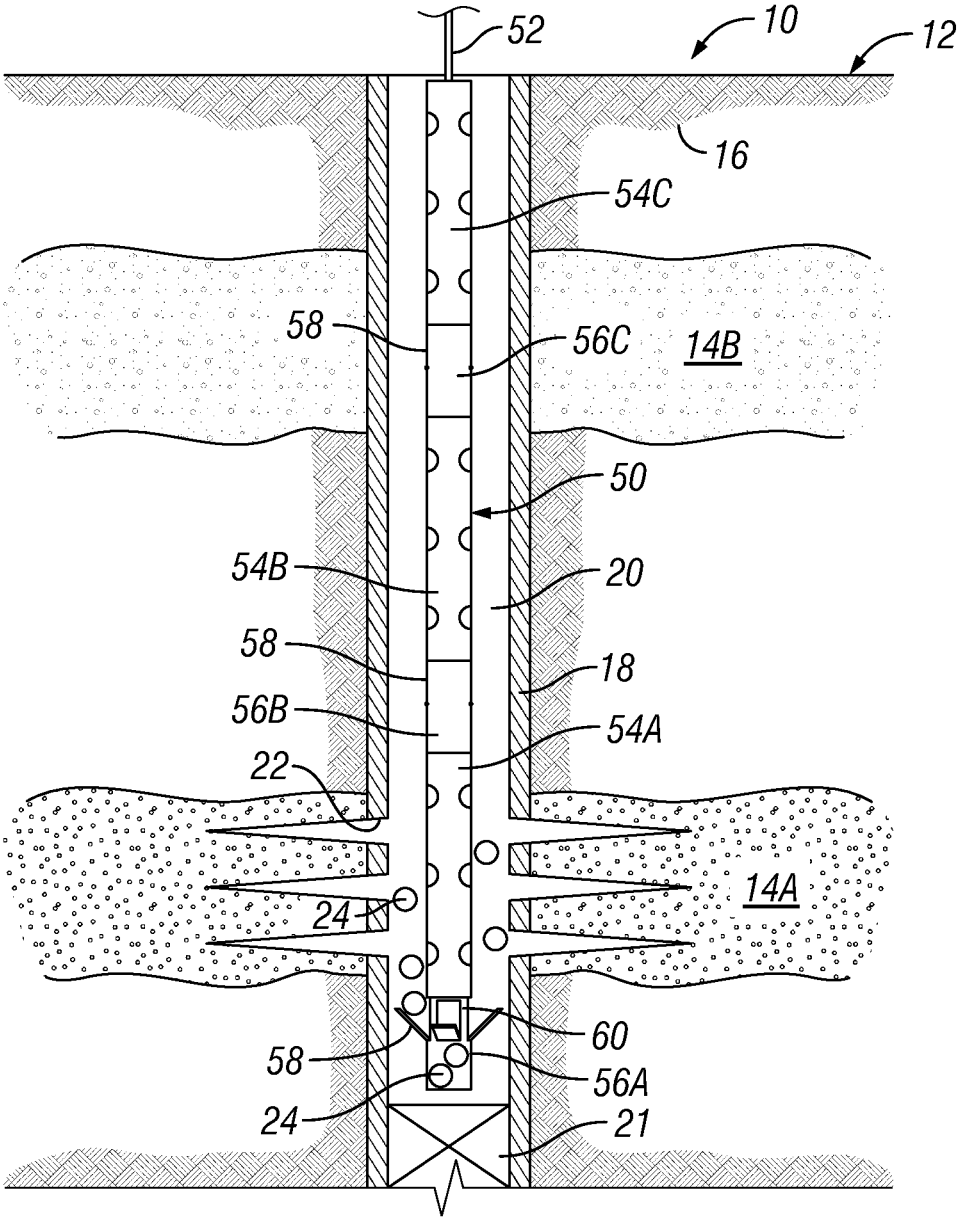
FIG. 4 is an elevational cross-sectional view of a downhole portion of a well formed in a subterranean formation employing downhole containers carried on an perforating gun assembly for releasing ball sealers into the wellbore for diverting fluid flow to portions of the formation.

FIG. 4 shows still another embodiment for the downhole placement of ball sealers. FIG. 4 shows a well 10 that is similar to that of FIGS. 1-3, with similar components labeled with the same reference numerals. Disposed within the wellbore 20 of the well 10 is a perforating gun assembly 50. The perforating gun assembly 50 is coupled to a wireline cable 52 that extends into the wellbore 20 from the wellhead at the surface. The perforating gun assembly 50 is provided with several perforating gun sections 54 for performing multiple perforating operations for perforating the well casing 18.

Provided with the perforating gun assembly 50 are ball sealer containers 56. A ball sealer container 56 is provided below an associated perforating gun section 54 on the assembly 50. The container 56 is screwed or otherwise coupled to the assembly 50 and is appropriately dimensioned to generally the same dimensions (e.g. 3-5 inches in diameter). Thus, the lowermost container 56A is located below its associated perforating gun section 54A, the container 56B is located immediately above perforating gun section 54A but below its associated perforating gun section 54B, and container 56C is located below perforating gun section 54C and so forth. In other embodiments, the containers 56 may be located above an associated perforating gun section. Additional perforating gun sections and containers may be provided on the assembly 50 corresponding to the number zones or intervals to be stimulated or treated.

Each of the containers 56 has a capacity to carry a sufficient quantity (e.g. 20 to 30 or more) of ball sealers for performing a diverting job for a particular perforated zone. Each of the containers 56 is provided with one or more doors or closures 58 for selectively closing an opening 60 of the container 56. The doors or closures 58 may be located at the upper ends of the containers 56 to facilitate the release of the ball sealers from a position below the holes they are to seal. The containers 56 provided on the assembly 50 may be used in a sealing or diverting operation wherein the ball sealers are released below the holes or perforations they are intended to seal.

Referring to FIG. 4, which shows the operation of the assembly 50, after an initial zone 14A is perforated with perforating gun section 54A and the treatment is concluded for the zone 14A. Upon conclusion of the treatment, the assembly 50 is positioned within the wellbore 20 so that the container 56A is at a position below the perforations 22. This may be achieved by repositioning the assembly 50 (raising or lowering) or the lower position of the container below the perforating gun section 54A may enable the assembly 50 to remain in place so that no repositioning is necessary. The door or doors 58 to container 56A are opened through a command transmitted from the surface via wireline 52. This allows the ball sealers 24 within the container 56A to be released. The ball sealers 24 are formed so that they are buoyant within the fluid within the wellbore or have a density that is less than the fluid so that they float upward to the holes or perforations 22 of zone 14A. Pumping from above then drives the ball sealers into the perforations to effectively seal the holes or perforations 22 of zone 14A.

In treatment of the subsequent zones, fluid that is lighter than the ball sealers of the previously treated zone may be used so that the ball sealers from the lower zones do not migrate above the subsequent zones being isolated. Thus, in treating zone 14B, the assembly 50 is raised so that perforating gun section 54B is adjacent zone 14B and the conduit 18 is perforated. A lighter, lower density treatment fluid is introduced and used to carry out treatment of zone 14B. Upon conclusion of the treatment, the doors 58 of container 56B are opened and the ball sealers contained therein are released to seal the perforations (not shown) of zone 14B. This process may be repeated for subsequent zones until all desired intervals are treated.

In other embodiments, the containers 56 may be located on the assembly 50 at a position above its associated perforating gun section 54. The ball sealer could be buoyant or even be non-buoyant.

This configuration may be used when the ball sealers are non-buoyant within the fluid. In such cases, the closure 58 and opening 60 of the container 56 may be located at a lower end or other position to facilitate release of ball sealers at a position above the holes or perforations that are intended to be sealed.

In other embodiments, the containers used downhole for releasing the ball sealers may be employed on a separate assembly (not shown) from that of the perforating gun, or they may be provided with the casing string, as discussed previously. Additionally, the downhole containers used for the release of ball sealers may be used in combination with monitoring tags and tag monitoring devices, as described previously, to further facilitate accurate placement and provide location information regarding the ball sealers.

Any carrier fluid may be used, provided that it can carry the ball sealers in the manner described, and does not unduly degrade or dissolve the ball sealers until they are no longer needed. The fluid may, for example, be nitrogen, water, brine, slickwater, a foam, an acid, a gelled oil, or water viscosified, for example, with a linear polymer, a crosslinked polymer, or a viscoelastic surfactant. A sealing agent may also be used in combination with the ball sealers. U.S. patent application Ser. No. 12/103,041, filed Apr. 15, 2008, hereby incorporated in its entirety by reference, describes such sealing agents and their use. Such sealing agents may also be released downhole, such as through the containers already described, which may be the same or different than those containing the ball sealers. Additionally, the sealing agents may themselves constitute the monitoring tag if they are used in a combination with a monitoring device configured for monitoring the sealing agent.

The methods and devices described herein may be used in any type of well and situation in which ball sealers are used: vertical, deviated, horizontal, and multiple boreholes; production, storage, injection, and others; stimulation, completion, workover, remediation, and others; wells for hydrocarbons, carbon dioxide, water, brine, helium and other fluids.

While the invention has been shown in only some of its forms, it should be apparent to those skilled in the art that it is not so limited, but is susceptible to various changes and modifications without departing from the scope of the invention. Accordingly, it is appropriate that the appended claims be construed broadly and in a manner consistent with the scope of the invention.

We claim:

1. A method for performing a well operation, the method comprising:

providing a container within a well at a known downhole location within the well, the container containing at least one ball sealer, wherein the container is located at a position below holes in a casing of the well, and wherein the ball sealer is released in a fluid having a higher density than the ball sealer so that the ball sealer is buoyed upward by the fluid toward the holes in the casing;

releasing the at least one ball sealer from the container within the well at the known downhole location in response to an instruction initiated from a surface location; and providing a tag with the at least one ball sealer in a carrier fluid containing the at least one ball sealer to facilitate monitoring of the downhole location of the at least one ball sealer.

2. The method of claim 1, wherein:

at least two containers are provided that are spaced apart from each other, each container containing at least one ball sealer; and wherein the at least one ball sealer of each container is released from the container in response to an instruction initiated from a surface location.

3. The method of claim 1, further comprising:

providing a tag monitoring device within the well for monitoring the downhole location of the tag;

introducing the at least one ball sealer and carrier fluid downhole with the tag into at least one perforation; and communicating information to a surface location from the tag monitoring device regarding the downhole location of the tag to a remote monitoring location to provide an indication of the downhole location of the tag relative to the at least one perforation within the well.

4. The method of claim 3, wherein:

the tag monitoring device is positioned on a retrievable downhole tool.

5. The method of claim 4, wherein:

the tag monitoring device is provided in the well through a wireline cable.

6. The method of claim 3, wherein:

the tag monitoring device is coupled to a casing of the well.

7. The method of claim 3, wherein:

information from the tag monitoring device is communicated to the surface location through at least one of an electrical signal, a hydraulic line, a sonic pulse, a pressure pulse, and an electro-magnetic signal.

8. The method of claim 3, wherein:

the tag monitoring device is provided at a known position with the well.

9. The method of claim 1, wherein:

the tag comprises at least one of a radio frequency identification (RFID) tag, transponder tag, a metal tag, a magnetic tag, a chemical tag, an optically readable tag, a ionizing radiation emitting tag, and a non-ionizing radiation emitting tag.

10. The method of claim 1, wherein:

the tag is provided on a plurality of ball sealers.

11. The method of claim 1, wherein:

the tag is provided in the carrier fluid.

* * * * *